US006591432B1

(12) United States Patent
Feinstein et al.

(10) Patent No.: US 6,591,432 B1
(45) Date of Patent: Jul. 15, 2003

(54) ANTI-DRIFT SHOWER CURTAIN HAVING WATER-COLLECTING POCKETS

(76) Inventors: Matthew J. M. Feinstein, 960 Stonegate Dr., Highland Park, IL (US) 60035; Steven B. Feinstein, 960 Stonegate Dr., Highland Park, IL (US) 60035

( * ) Notice: Subject to any disclaimer, the term of this patent is extended or adjusted under 35 U.S.C. 154(b) by 0 days.

(21) Appl. No.: 09/916,909

(22) Filed: Jul. 26, 2001

(51) Int. Cl.[7] ..... A47K 3/36
(52) U.S. Cl. ..... 4/558; 160/DIG. 6
(58) Field of Search ..... 4/558, 608, 557, 4/607, 613; 160/DIG. 6

(56) References Cited

U.S. PATENT DOCUMENTS 2,173,993 A * 9/1939 Amdur ..... 4/608
2,668,298 A * 2/1954 Kimmons
2,817,850 A * 12/1957 Barbour et al. ..... 4/608
3,035,275 A * 5/1962 Strebeigh ..... 4/608
D370,583 S * 6/1996 Fiddler ..... D6/578
5,761,751 A * 6/1998 Morrissey ..... 4/558
6,178,571 B1 * 1/2001 McAllister ..... 4/613
6,192,965 B1 * 2/2001 Hinds ..... 160/330

* cited by examiner

*Primary Examiner*—Charles R. Eloshway
(74) *Attorney, Agent, or Firm*—Carol D. Titus; Gregory Smith & Associates

(57) ABSTRACT

A shower curtain having one or more pockets formed near the lower edge and on the side facing the shower nozzle is disclosed. The pockets are designed to collect water while the shower is in use. The pockets have drain holes that allow the water to slowly drain, such that while the shower is in use, the pockets will fill, but when the shower is shut off, the pockets will slowly drain until they are empty. The pockets are in fluid communication with one another by way of openings extending between the pockets. The bottom edge of the pocket is sloped with the highest point of the bottom wall at or near the center of the shower curtain encouraging water to flow toward the edges. Below the pockets, the shower curtain is formed of an air permeable material such as nylon mesh.

12 Claims, 2 Drawing Sheets

= Heat Seal Zones

= Pocket Sheet (Seal to Main Sheet in designated areas)

ANTI-DRIFT SHOWER CURTAIN HAVING WATER-COLLECTING POCKETS

FIELD OF THE INVENTION

The present invention relates to shower curtains. More particularly, it relates to a shower curtain having water-collecting pockets along the inner lower edge and mesh for the lower portion of the shower curtain, thereby reducing or eliminating the problem of the shower curtain drifting inward while the user is taking a shower.

BACKGROUND OF THE INVENTION

Conventional shower curtains are typically made of a uniform sheet of plastic or rubberized material that is prone to drifting inwards on the user while the shower is running. The current theory to explain the phenomenon is derived by an analysis of the physics of thermal air masses. Specifically, if the shower is turned on and hot water is sprayed from the nozzle, warm air/steam is created and begins to rise. The steam rising from the shower basin or tub creates a void that is filled by air moving in from the lower edge of the shower curtain. As the air moves in, the shower curtain is carried inward as well.

Several types of shower curtains and shower curtain accessories have been developed to try to address the problem. For example, there are clips designed to hold the edges of the shower curtain to the tub. Weights or magnets may be embedded in the curtain material or they may be clipped on by the user. There are devices that act as a backbone for the shower curtain. These may take the form of ribs in the shower curtain or it may be an arm that is attached to the shower curtain rod or other structure of the shower to force the curtain to maintain its shape. Alternate shower curtains may be attached at both sides and slide up or down into place for use.

While some of these designs may be somewhat effective, the prior art designs are unsightly, expensive, complicated and/or ineffective. Therefore, there is a clear need in the industry for a shower curtain that is inexpensive to manufacture and sell, easy to install and use and aesthetically pleasing to the user, while effectively solving the problem of the shower curtain drifting in on the shower occupant.

SUMMARY OF THE INVENTION

The present invention takes the form of a shower curtain having one or more pockets formed in the lower edge. The pockets are located on the side of the shower curtain facing the shower nozzle. The pockets are designed to collect water while the shower is in use. The collected water creates additional weight near the bottom edge of the shower curtain, thereby acting against the forces pushing the shower curtain toward the user. To prevent the build up of organisms that grow in moist or wet environments, the bottom edge of the pockets have drain holes that allow the water to slowly drain out of the pockets. The holes are sized and configured to drain the water slowly, such that while the shower is in use, the pockets will fill and remain generally full, but when the shower is shut off, the pockets will slowly drain until they are generally empty. The pockets are in fluid communication by way of openings extending between the pockets. The bottom edge of the pocket is sloped with the highest point of the bottom wall at or near the center of the shower curtain. The slope encourages water to flow toward the edges of the sheet. Along the lower edge of the shower curtain, below the pockets, the shower curtain is formed of an air permeable material such as nylon mesh. The nylon mesh allows air to pass through the shower curtain, thereby allowing the air into the lower portion of the shower basin without carrying in the shower curtain. The height of the nylon mesh is chosen such that the top edge of the nylon mesh will be located below the upper edge of the shower basin. Suitable air permeable materials include polymer or fabric meshes, screens or porous material. In one embodiment, the air permeable material comprises multiple perforations or slits made into the shower curtain material in the desired areas. Other objects and advantages of the invention will no doubt occur to those skilled in the art upon reading and understanding the following detailed description along with the accompanying drawings.

DETAILED DESCRIPTION

Figure 1:
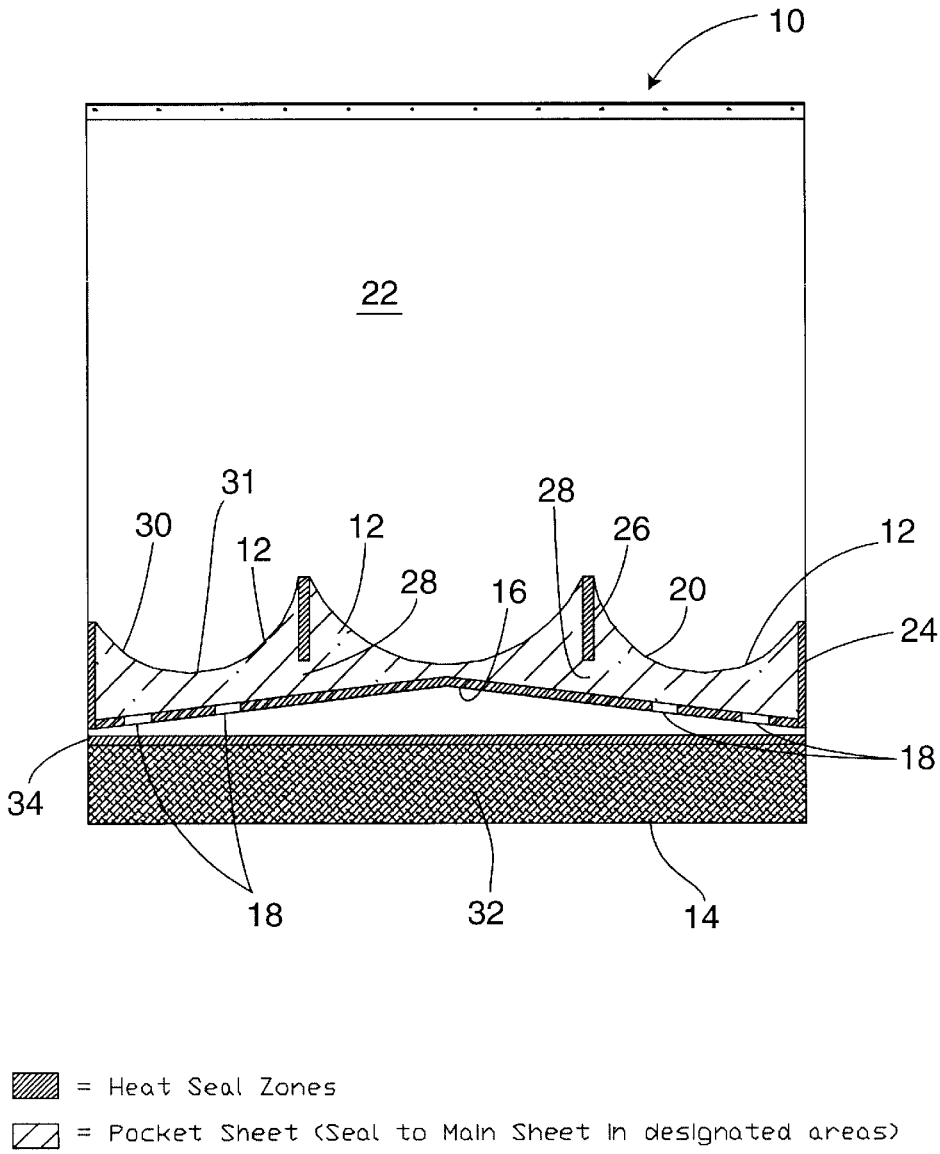
FIG. 1 is a shower side view of the shower curtain.

FIG. 1 is a shower side view of the shower curtain 10 of the present invention. The shower curtain 10 has one or more pockets 12 formed in or near the lower edge 14 of the shower curtain 10. The pockets 12 are located on the side of the shower curtain 10 facing the shower nozzle. The pockets 12 are designed to collect water while the shower is in use. The collected water creates additional weight near the bottom edge 14 of the shower curtain 10, thereby acting against the forces pushing the shower curtain 10 in toward the user. To prevent the build up of organisms that grow in moist or wet environments, the bottom edge 16 of the pockets 12 have drain holes 18 that allow the water to slowly drain out of the pockets 12. The holes 18 are sized and configured to drain the water slowly, such that while the shower is in use, the pockets 12 will fill and remain generally full, but when the shower is shut off, the pockets 12 will slowly drain until they are generally empty. The depth of the pocket will affect how well the shower curtain 10 stays in place. The pockets may be in the range of 2 to 20 inches deep, more preferably between 4 and 15 inches deep, most preferably between 6 and 12 inches deep. In the embodiment shown, the deepest part of each pocket is 10 inches deep.

In the embodiment shown, a pocket sheet 20 is sealed to a main sheet 22 along the bottom edge 16 of the pocket 12 and the side edges 24 of the pocket sheet 20. Three pockets 12 are formed by sealing the pocket sheet 20 to the main sheet 22 along two additional vertical lines 26. The length of these lines 26 will vary depending on the desired depth of the pocket. The connection lines 26 may be in the range of 0.25 to 20 inches long or more, more preferably in the range of 3 to 12 inches, most preferably between 5 and 10 inches. In the embodiment shown, the lines are approximately 8 inches long. Alternate embodiments could use spots or clips to hold the sheet 20, 22 layers together.

Although the pockets 12 may be completely separate from one another, in the embodiment shown, the pockets 12 are in fluid communication by way of openings 26 formed below the bottom end of the vertical or spot connections 26. Although the embodiment shown uses three pockets 12, the number of pockets 12 may be varied anywhere form a single large pocket to a multitude of small pockets 12. Further, the pockets 12 shown are generally continuous along the shower curtain 10. If preferred, a plurality of discrete pockets could be formed at specific locations across the width of the shower curtain 10.

Figure 2:
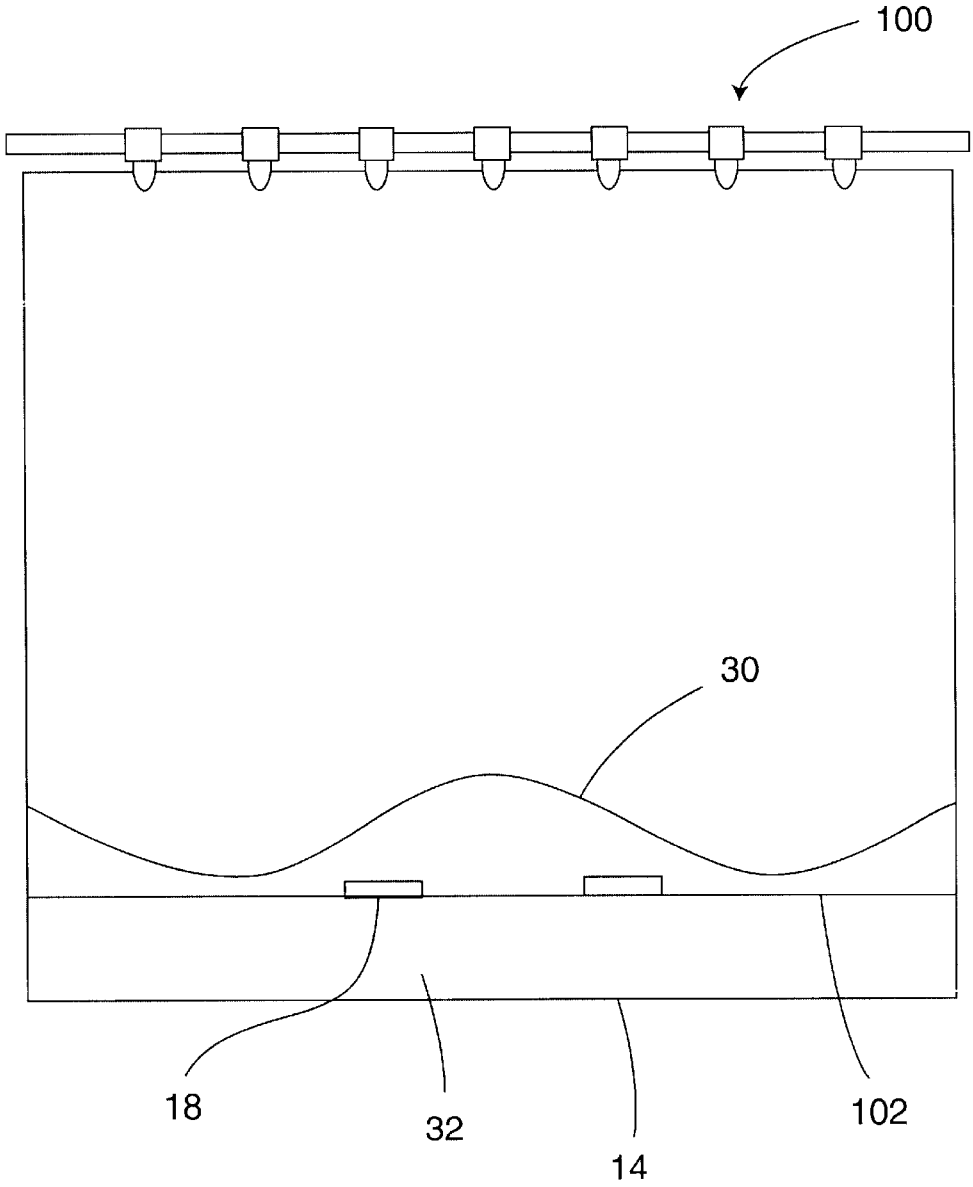
FIG. 2 is a shower side view of a second embodiment of the shower curtain.

Although not required, the bottom edge 16 of the pockets 12 may be sloped as shown in FIG. 1. The highest point of the bottom wall 16 is at or near the center of the shower curtain 10. The bottom wall 16 slopes downward toward both edges 24. The slope may be in the range of 0.5 to 30 percent, more preferably between 5 and 20 percent, most preferably between 10 and 15 percent. In the embodiment shown, the slope is approximately 12 percent. The slope encourages water to flow toward the edges 24 of the shower curtain 10. The edges 24 of the shower curtain 10 typically receive the least amount of shower spray, but are most prone to drifting inwards on the user. In the embodiments where the bottom edge 16 of the pockets 12 is sloped, it is important that at least one drain hole 18 be located at or near the low point(s) of the shower curtain 10 to allow for proper drainage. FIG. 2 shows a version of the shower curtain 100 with a straight bottom edge 102.

Although the top edge 30 of the pockets 12 may be straight, in the embodiment shown, the top edge 30 of each pocket 12 has a curvature forming points or cusps at the connections 26 between the sheets 20, 22. The radius of curvature will depend on the width of the pockets 12 and the overall depth of the pockets 12. If the top edge 30 is curved, the range of radii may be from 1 to 35 inches, more preferably from 5 to 20, most preferably between 8 and 15 inches. The embodiment shown has a radius of 10.5 inches for the two edge pockets 12 and the center pocket 12 has a radius of 14 5/16 inches.

The pockets 12 may have a thicker and/or more rigid lip 31 that forms the top edge 30 of the pocket 12. The lip 31 of the pocket 12 helps to hold the pockets 12 open such that water flowing from the showerhead may enter the pocket 12. The lip 31 may be formed by adding an additional layer of the shower curtain material along the top edge or by attaching a rib of other material. In alternate embodiments, a sleeve could be created and the user could thread in a pre-shaped or malleable member that would hold the edge of the pocket in a chosen configuration. The user could then adjust the amount the pocket extended out to adjust the amount of water entering the pockets.

Depending on the configuration of the pockets 12, the shower curtain 10 may have between one and one hundred or more drain holes 18 along its length. The drain holes may be sized between 0.01 and 3 inches, preferably between 0.05 and 1 inch, more preferably between 0.1 and 0.5 inches and most preferably between 0.125 and 0.25 inches. The embodiment show has the drain holes 18 concentrated toward the edges of the shower curtain 10. In the drainage section of the shower curtain 10, there are preferably between one and forty drain holes 18 per linear foot, more preferably between one and twenty drain holes 18. Most preferably, the shower curtain 10 has between two and ten drain holes 18 per linear foot with the center half of the shower curtain 10 having no drain holes 18. The drain holes 18 may have constant spacing over the length of the drainage area, or the holes 18 may become more frequent or larger towards the edge of the shower curtain 10.

The number of drain holes 18 may also be affected by the size of the holes 18. The total length of the drain holes 18 should be a percentage of the total length of the shower curtain 10. Therefore, as the size of the holes 18 decreases, the number of holes 18 increases. The optimal percentage will vary somewhat based on unknown factors such as the type of shower nozzle, the user's body shape and position, the water pressure, etc. Also, the location of the drain holes 18 and the configuration of the bottom edge of the pockets 12 will also affect the size and number of drain holes 18. For typical usage, the percentage of drain hole to the length of curtain 10 is between 0.1 to 30 percent, preferably between 0.5 and 25 percent, more preferably between 2 and 20 percent, most preferably between 5 and 10 percent.

Along the lower edge 14 of the shower curtain 10, below the pockets 12, the shower curtain 10 is formed of an air permeable material 32 such as nylon mesh. The air permeable material 32 allows air to pass through the shower curtain 10, thereby allowing air into the lower portion of the shower basin without carrying in the shower curtain 10. The height of the air permeable material 32 is chosen such that the top edge of the air permeable material 32 will be located below the upper edge of the shower basin. For typical usage, the air permeable material 32 will have a height in the range of 2 to 20 inches, more preferably between 4 and 12 inches, most preferably between 6 and 10 inches. In the embodiment shown, the air permeable material 32 has a height of approximately 7.5 inches. Suitable air permeable materials include polymer or fabric meshes, screens or porous material. In one embodiment, the air permeable material comprises multiple perforations or slits made into the shower curtain material in the desired areas.

The pocket sheet 20 may be formed by folding the bottom edge 34 of the main sheet 22 upwards. In this case, the optional air permeable material 32 may be added to the folded edge of the shower curtain 10.

The connections between the sheets 20, 22 may be formed by sewing, heat welding, ultrasonic welding or any other suitable attachment technique.

Testing of a prototype shower curtain 10 found the prototype shower curtain substantially reduced the inward drift compared to a control shower curtain. The control shower curtain was a typical magnetized plastic shower curtain. The prototype reduced the inward drift up to 55 percent over the control in the areas where drift is typically most problematic.

For optimal sanitization, the shower curtain 10 may be coated on one or both sides with an anti-microbial solution or material that is antibacterial and/or anti-fungal. Alternately, the shower curtain 10 may be formed of a material having anti-microbial properties.

Many features have been listed with particular configurations, options, and embodiments. Any one or more of the features described may be added to or combined with any of the other embodiments or other standard devices to create alternate combinations and embodiments.

Although the examples given include many specificities, they are intended as illustrative of only a few possible embodiments of the invention. Other embodiments and modifications will, no doubt, occur to those skilled in the art. Thus, the examples given should only be interpreted as illustrations of a few of the preferred embodiments of the invention, and the full scope of the invention should be determined by the appended claims and their legal equivalents.

What is claimed is:

1. A shower curtain for use with a shower having a shower basin and a shower nozzle, comprising:

a main sheet having a bottom portion, said bottom portion being air permeable material and sized and configured to be located below the top edge of the shower basin, a second sheet having a bottom edge, a top edge, a first side, a second side and a middle portion, said second sheet being attached to said main sheet along said bottom edge, said first side, said second side, a plurality of pockets formed by connecting said second sheet to said main sheet at a plurality of locations in said middle portion, a bottom edge of said plurality of pockets being sloped downward towards said first and second sides of said second sheet, said bottom edge of said middle portion of said pockets being imperforate, a first drain hole located proximate said first side, and a second drain hole located proximate said second side, wherein said bottom portion of said main sheet is located below said bottom edge of said second sheet.

2. The shower curtain of claim 1 wherein said plurality of pockets is three pockets and said plurality of locations is two locations.

3. The shower curtain of claim 1 wherein each of said plurality of locations is formed by a generally vertical line.

4. The shower curtain of claim 3 wherein a lower end of said vertical line ends above said bottom edge of said second sheet, thereby leaving an opening connecting said plurality of pockets.

5. The shower curtain of claim 1 wherein said plurality of locations is formed such that a lower end thereof ends above said bottom edge of said second sheet, thereby leaving an opening connecting said plurality of pockets.

6. The shower curtain of claim 1 wherein said top edge of said second sheet has a plurality of upwardly facing concave curved sections.

7. The shower curtain of claim 6 wherein said plurality of upwardly facing concave curved sections meet at said plurality of locations forming a cusp at a top end of each of said plurality of locations.

8. The shower curtain of claim 1 further comprising third and fourth drain holes located between said first and second drain holes.

9. The shower curtain of claim 1 wherein said slope forms a high point proximate a middle of said second sheet, wherein said bottom edge of said plurality of pockets forms a single downwardly-facing concave shape.

10. The shower curtain of claim 1 wherein said first and second drain holes are two of a plurality of drain holes forming between 5 and 10 percent of the bottom edge.

11. The shower curtain of claim 1 wherein said at least one pocket is formed by folding a bottom edge of said main sheet.

12. A shower curtain for use with a shower having a shower basin and a shower nozzle, comprising:

a main sheet having an air permeable bottom portion, said bottom portion being sized and configured to be located below the top edge of the shower basin, a second sheet having a bottom edge, a top edge, a first side, a second side and a middle portion, said second sheet being attached to said main sheet along said bottom edge, said first side, said second side, and a first and a second vertical line in said middle portion, said first and second vertical lines forming three pockets open along top edges thereof, said second sheet located above said air permeable bottom portion, a bottom edge of said pockets being imperforate, a lip attached to the top edge of said three pockets, first and second openings connecting said three pockets, said openings located below said first and second vertical lines, said top edge of said second sheet having first, second and third upwardly facing concave curved sections, said first and second curved sections creating a first cusp at said first vertical line, said second and third curved sections creating a second cusp at said second vertical line, a first drain hole located proximate said first side of said second sheet, a second drain hole located proximate said second side of said second sheet, a third drain hole and a fourth drain hole located proximate a bottom edge of said second sheet and between said first and second drain holes, wherein said bottom edge is sloped to form a high point between said first side and said second side.

* * * * *